United States Patent [19]

Lundquist et al.

[11] 4,373,661

[45] Feb. 15, 1983

[54] CARTON WITH INSPECTION FLAP AND EASY OPENING FEATURES AND BLANKS THEREFOR

[75] Inventors: Burton R. Lundquist, Pinnacle Peak; Thomas A. Kozlowski, Phoenix, both of Ariz.

[73] Assignee: Armour and Company, Phoenix, Ariz.

[21] Appl. No.: 906,542

[22] Filed: May 17, 1978

[51] Int. Cl.[3] ..... B65D 5/42

[52] U.S. Cl. ..... 229/87 F; 206/629

[58] Field of Search ..... 229/87 F; 206/629

[56] References Cited

U.S. PATENT DOCUMENTS

| | | | |
|---|---|---|---|
| 2,557,914 | 6/1951 | Miller | 206/629 |
| 2,828,060 | 3/1958 | Brown | 206/629 |
| 3,409,445 | 11/1968 | Hall | 229/87 F |
| 3,722,783 | 3/1973 | Rous | 206/629 |
| 3,724,741 | 4/1973 | Jacobson | 206/629 |
| 3,958,748 | 5/1976 | Smith et al. | 206/629 |
| 3,960,315 | 6/1976 | Dobbins | 229/87 F |

*Primary Examiner*—Stephen P. Garbe

*Attorney, Agent, or Firm*—Frank T. Barber

[57] ABSTRACT

A paperboard carton with improved tear resistance and blanks therefor for packaging a product such as bacon, said carton having an inspection flap for viewing the contents and scoring lines which provide easy opening of the carton. The tear resistance of said carbon is improved by the positioning of the scoring lines which are located such that lines of force initially created by lifting the inspection flap do not intersect a ply-separation area located within the edge section of the top panel.

4 Claims, 10 Drawing Figures

CARTON WITH INSPECTION FLAP AND EASY OPENING FEATURES AND BLANKS THEREFOR

BACKGROUND OF THE INVENTION

1. Field of the Invention

This invention relates to an improvement in paperboard cartons and blanks therefor, and more particularly to an improvement in cartons suitable for storing and displaying bacon and other products, said improvement permitting prospective purchasers to view the contents of the carton without tearing the carton.

2. Description of the Prior Art

Paperboard manufactured by cylinder type or Fourdrinier processes has been used as a packaging material for bacon and other food products for many years. Typical paperboard stock is approximately fourteen thousandths (0.014) of an inch thick and is composed of multiple layers of paper fibers called plies. Using such paperboard, cartons have been designed which can be assembled, filled and securely sealed by machine, yet which contain easy-opening features for the consumer. One well-known means of providing an easy-opening feature is to score a carton by mechanically cutting it to a depth of approximately one-half its thickness along the length of the scoring line. Scoring has typically been located adjacent to the glue line where the opening flap is connected. When this flap is lifted, thin layers (plies) of paperboard separate along the line of weakness created by the scoring and permit the carton to be opened with minimum effort.

Since 1973, the U.S. Dept. of Agriculture has required that bacon packages be constructed with a cutout viewing area or window through which at least 70% of a representative slice of bacon can be inspected (see 9CFR317.8). As a result of this regulation and the negotiations which led to it, a number of carton designs were developed which incorporated an inspection flap. This flap could be readily lifted to examine a representative slice; however, a serious problem with these prior art cartons was the tearing which often occurred when a prospective purchaser viewed the contents. Such tearing damaged the carton and resulted in many unattractive and non-saleable packages.

Recently, improved carton designs were disclosed in U.S. Pat. No. 3,960,315 which issued June 1, 1976 to T. E. Dobbins, assignor to American Can Company. These designs provided for hinged inspection flaps adjacent to reinforced edge sections which reportedly prevented tearing of the cartons beyond the hinge line. The designs disclosed nothing relating to the use of scoring lines for providing easy-opening features; however, in commercial use, such features have been incorporated. We have found that this design, as modified to include the scoring, reintroduces the tearing problem encountered with the prior art cartons. This defect has been recognized but the only solution offered, prior to the present invention, was to add an extra thickness of paperboard to the top panel to reinforce the carton.

SUMMARY OF THE INVENTION

The present invention concerns our discovery that easy-opening features can be included in carton designs while still maintaining the strength of the carton. We have found that by controlling the lengths and locations of the scoring lines which permit cartons to be easily opened, substantial increases in tear-resistance can be obtained over the prior art. Further advantages of our invention will become apparent from the detailed description and drawings wherein.

FIG. 1 illustrates a typical prior art carton;

FIGS. 2*a* and 2*b* further illustrate some additional features of a typical prior art carton;

FIG. 2*c* illustrates the tearing that can occur with a typical prior art carton;

DETAILED DESCRIPTION OF PREFERRED EMBODIMENTS

Figure 1:
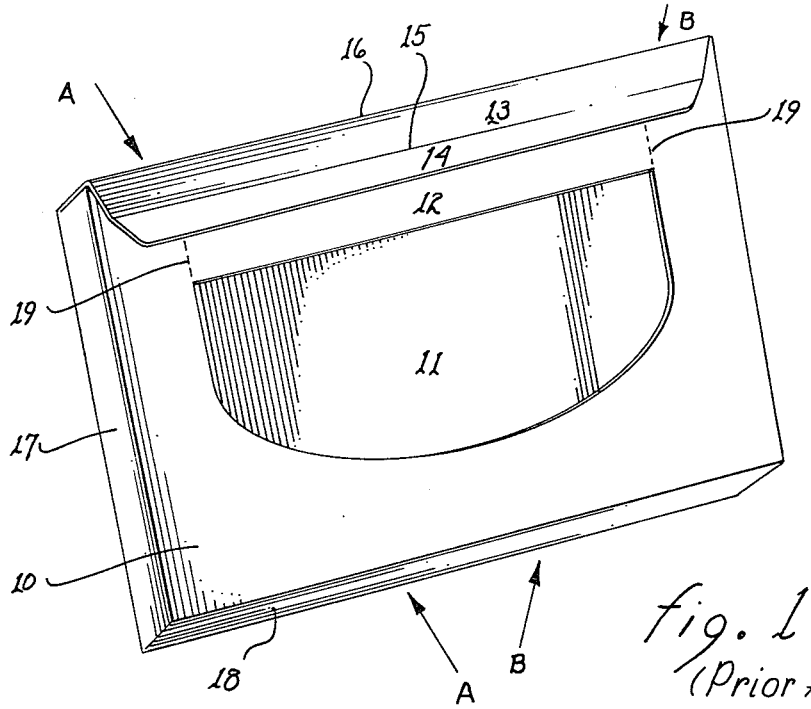
fig. 1 (Prior Art)

In order to better understand our invention it is necessary to first understand the defect inherent in the prior art cartons. FIG. 1 illustrates a typical carton manufactured according to U.S. Pat. No. 3,960,315, but including easy-opening features. Illustrated features are a top panel 10 containing a window 11, an inspection flap 12 and lines of weakness 19; a glue flap 13 with fold lines 15 and 16, and an opening tab 14; and side panels 17 and 18.

Figure 2A:
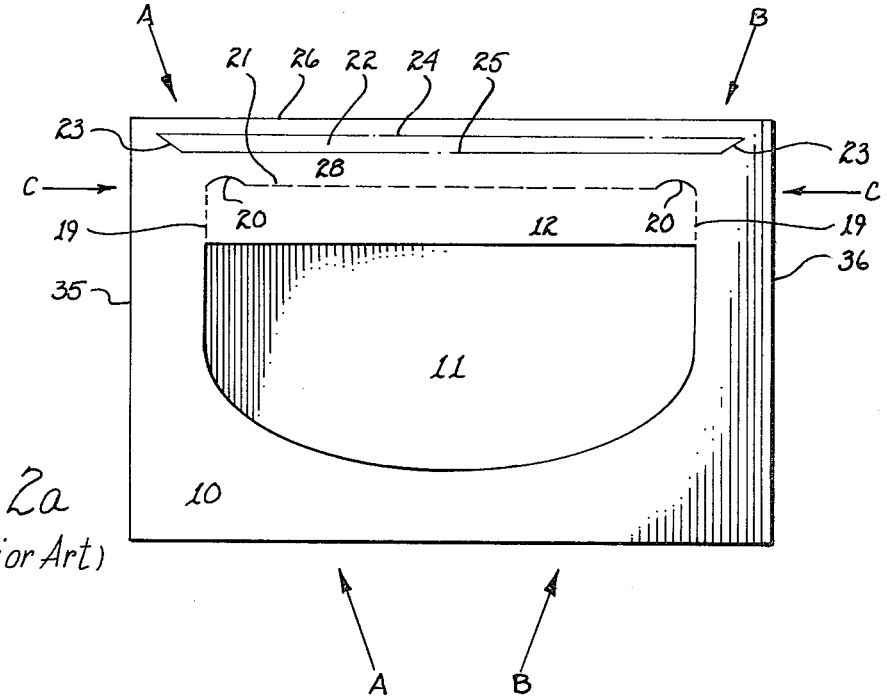
fig. 2a (Prior Art)
Figure 2B:
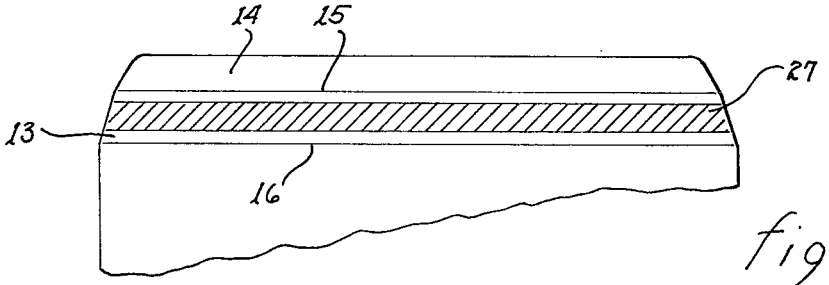
fig. 2b (Prior Art)

FIGS. 2*a* and 2*b* further illustrate some features of top panel 10 and glue flap 13 which are hidden from view in FIG. 1. FIG. 2*a* illustrates ply-separation area 22 bounded by scoring lines 23, 24 and 25, which arrangement of scoring lines is typically found in the prior art to introduce the easy-opening feature of the cartons. Ply-separation area 22 lies parallel to inspection flap 12 and within edge section 28, an area bounded by top panel edges 26, 35 and 36, and an imaginary line CC drawn along hinge line 21. When glue flap 13 is closed, adhesive 27 spread on the bottom of glue flap 13 (FIG. 2*b*) comes in contact with top panel 10 between scoring lines 24 and 25, sealing the carton. The area of contact crosses almost the entire width of top panel 10 between panel edges 35 and 36.

Easy opening is accomplished by lifting opening tab 14 to apply stress along scoring line 25. Stress separates the two paperboard pieces (glue flap 13 and top panel 10) by allowing a thin strip composed of one or more plies of paperboard (outlined by area 22) to separate from edge section 28 of top panel 10. This occurs because of the weakness created by scoring the carton. However, if adhesive 27 overlaps the scoring lines which define ply-separation area 22, the easy-opening feature will not work properly.

Also illustrated in FIG. 2*a* are semicircular cuts 20 which extend from lines of weakness 19. As described in the prior art, semicircular cuts 20 are intended to prevent tearing of the carton past hinge line 21 of inspection flap 12. In practice, however, prior art cartons with the features illustrated in FIGS. 1, 2*a* and 2*b* show particular weakness at the corners of viewing flap 12.

Figure 2C:
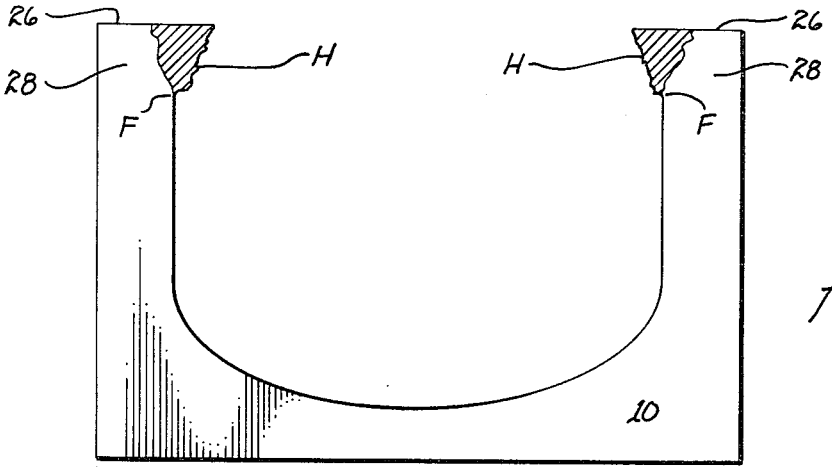

When inspection flap 12 is lifted in an upward manner, lines of force AA and BB are initially created which exert stress at the corners of the inspection flap approximately where lines of weakness 19 and semicircular cuts 20 intersect. Stress tends to initial tearing of the carton and, once this occurs, carton strength is markedly reduced. This often results in tearing completely across edge section 28; however, it will be noted that following the initial rupture, the direction of tearing across edge section does not necessarily follow lines of force AA and BB. It will also be noted that the tearing across edge section 28 is through the entire thickness of tap panel 10 and is thus completely different from the ply separation observed when top panel 10 and glue flap 13 are separated by lifting opening tab 14. FIG. 2*c* illustrates the tearing which can occur with a typical prior art carton. When inspection flap 12 is lifted in an upward manner, tearing starts approximately at points F where lines of weakness 19 and semicircular cuts 20 intersect. The way in which an individual carton tears following the initial rupture depends on many factors, including the strength of the paperboard and the manner in which inspection flap 12 is lifted. However, tearing normally occurs across edge section 28 to panel edge 26 within shaded areas H. When tearing is complete, the portion of edge section 28 which is torn away remains attached to glue flap 13.

The present invention fulfills a long-felt need for prior to our discovery no suitable means of minimizing tearing had been found. Only physical reinforcement of cartons had been attempted through the addition of a third layer of paperboard to top panel 10; however, the results were less than satisfactory.

We have discovered that the scoring of edge section 28 to provide for the easy opening feature of the carton contributes to the reduced tear resistance of edge section 28. When the lines of force AA and BB created by lifting inspection flap 22 intersect a scoring line located within edge section 28 and immediately adjacent to hinge line 21 of inspection flap 12, tearing of the carton is likely to occur. Furthermore, we have discovered that when scoring lines are located such that ply-separation areas located in edge section 28 are not intersected by lines of force AA and BB created by initially lifting inspection flap 12 in an upward manner, surprising increases in tear resistance can be obtained.

Figure 3:
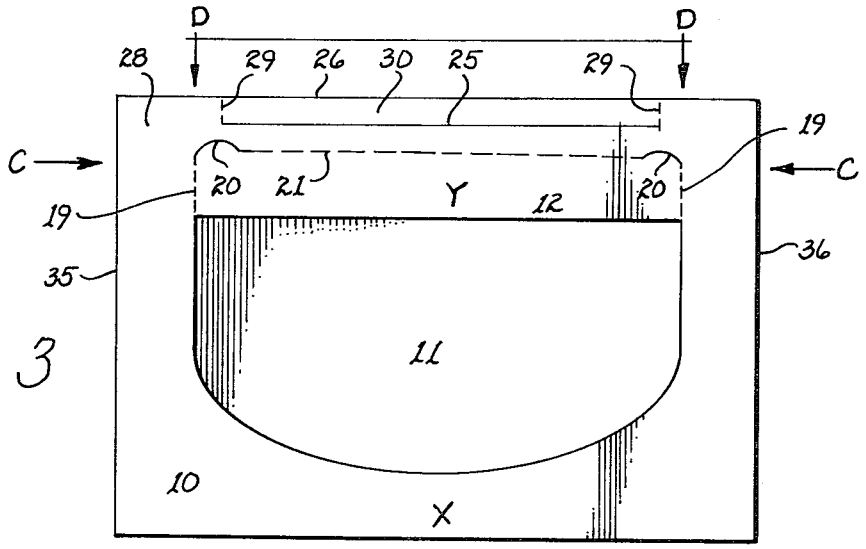
FIG. 3 illustrates one embodiment of the present invention wherein a single scoring line defines the edge of a ply separation area.

One preferred embodiment of our invention is illustrated in FIG. 3, wherein a single scoring line 25 is located parallel to hinge line 21 of top panel 10 and within edge section 28. It will be seen that scoring line 25 lies adjacent to inspection flap 12 and defines the edge of a ply-separation area 30 across which glue flap 13 attaches. When the carton is sealed, glue flap 13 containing adhesive 27 (as illustrated in FIG. 2*b*) comes in contact with top panel 10 across almost the entire width of said top panel between panel edges 35 and 36. Adhesive 27 crosses ply-separation area 30 between scoring line 25 and top panel edge 26, but lies immediately adjacent to scoring line 25. The length of scoring line 25, as illustrated in FIG. 3, is slightly less than the distance DD across inspection flap 12 between lines of weakness 19. It will further be noted that line 25 lies within the limits of the area defined by distance DD. When opening tab 14 is lifted to open a carton of the preferred embodiment illustrated in FIG. 3, a thin layer of paperboard separates from ply-separation area 30 of edge section 28 permitting the carton to be easily opened. Ply-separation area 30 is approximately defined by top panel edge 26, imaginary lines 29, and scoring line 25 (along which separation begins).

The significant improvement over the prior art of this and other preferred embodiments of our invention was studied by comparing the tear resistance of these cartons with the tear resistance of representative prior art cartons. Cartons used for all studies, whether prior art cartons or cartons containing our preferred embodiments, were constructed of commercial paperboard 0.014±0.001 inch thick and were of the same basic design. Carton blanks containing our preferred embodiments were prepared and glue flap 13 was sealed. The resulting glued shells were essentially two-dimensional cartons which needed only to be folded and glued into three-dimensional set-up cartons.

Representative prior art glued shells constructed according to FIG. 1 and glued shells containing our preferred embodiments were preconditioned for approximately 24 hours at 35° F. and 85% relative humidity, a temperature and humidity which would be expected in a grocer's display case. An Instron tensile strength tester was used to measure increased tear resistance. The bottom center of each glued shell was placed in one clamp of the instrument and the center of inspection flap 12 was placed in a second clamp in such fashion as to simulate the use of the inspection flap by a consumer, i.e., by grasping the center of the flap between thumb and index finger. The relative locations of these two points are illustrated by points X and Y, respectively, in FIG. 3. To ensure that representative carton strengths were measured, each carton was pretorn along lines of weakness 19 to the point where lines 19 and semi-circular cuts 20 intersect. The two clamps were moved apart and the force in pounds necessaryy to initiate tearing of the carton was measured. For cartons of the preferred embodiment illustrated in FIG. 3, tear resistance was measured as follows:

| | Force (lbs.) Required to Initiate Tearing | |
|---|---|---|
| Carton No. | FIG. 3 Carton | Prior Art Carton |
| 1 | 3.7 | 2.5 |
| 2 | 3.7 | 3.1 |
| 3 | 4.1 | 2.6 |
| 4 | 4.6 | 3.1 |
| 5 | 4.1 | 2.5 |
| 6 | 3.7 | 2.5 |
| Average | 4.0 | 2.7 |

The carton produced according to our invention has a tear resistance approximately 48% greater than the prior art carton. This was a truly surprising and unexpected result.

Figure 4:
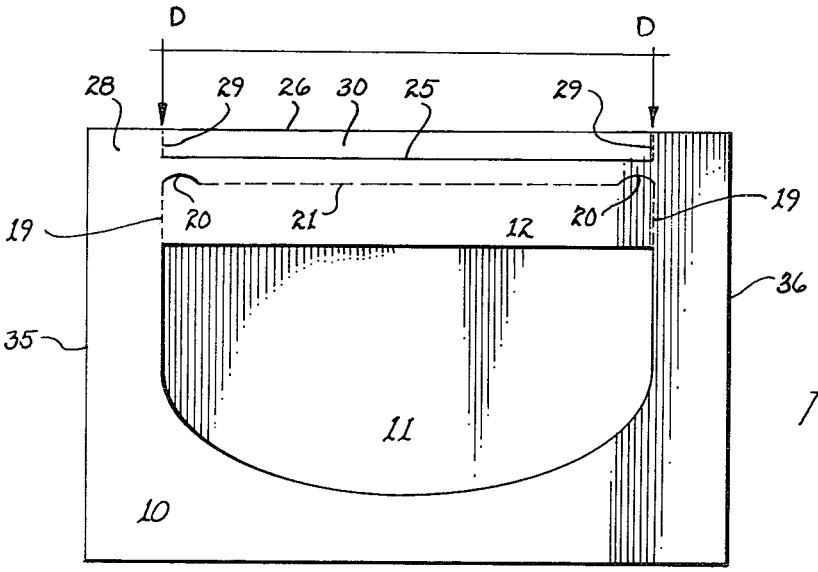
FIG. 4 illustrates another embodiment of the invention wherein a single scoring line is used to define an edge of the ply separation area.

A second preferred embodiment of our invention is illustrated in FIG. 4 wherein scoring line 25 is approximately the same length as the distance DD and the area of ply-separation area 30 is proportionally increased. Tests of this carton under the conditions specified above gave the following results:

| | Force (lbs.) Required to Initiate Tearing | |
|---|---|---|
| Carton No. | FIG. 4 Carton | Prior Art Carton |
| 1 | 4.0 | 2.5 |
| 2 | 3.6 | 3.1 |
| 3 | 3.8 | 2.6 |
| 4 | 4.2 | 3.1 |
| 5 | 3.9 | 2.5 |
| 6 | 3.3 | 2.5 |

-continued

| Carton No. | Force (lbs.) Required to Initiate Tearing | |
|---|---|---|
| | FIG. 4 Carton | Prior Art Carton |
| Average | 3.8 | 2.7 |

The carton produced according to the second preferred embodiment of our invention has a tear resistance approximately 41% greater than the prior art carton.

Figure 5:
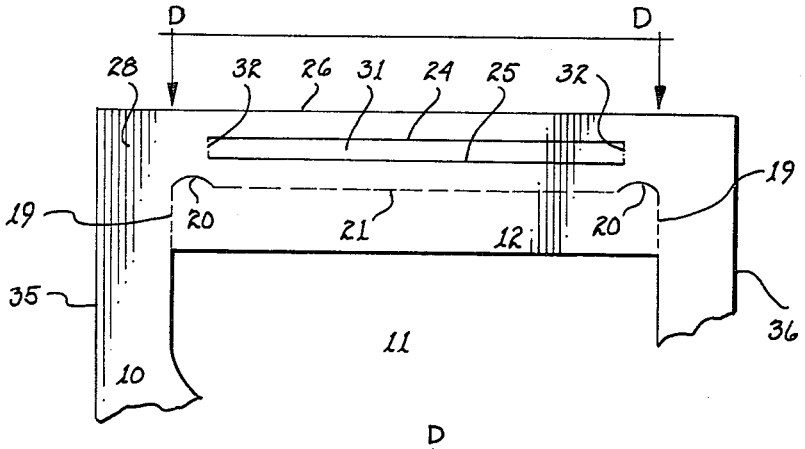
FIG. 5 illustrates an embodiment of the invention wherein two scoring lines of approximately the same length are used.

A third preferred embodiment of our invention is illustrated in FIG. 5, wherein two scoring lines 24 and 25 are of approximately the same length and are slightly shorter than the distance DD. Ply-separation area 31 defined by scoring lines 24 and 25 and by imaginary lines 32 is at substantially the same location where the glue flap attaches. When glue flap 13 is closed, adhesive 27 extends in typical fashion across top panel 10, between panel edges 35 and 36, and crosses ply-separation area 31 between scoring lines 24 and 25. Ply-separation area 31 is much smaller than ply-separation area 30 defined for FIGS. 3 and 4, and results in a cleaner opening of the carton. However, the average tear resistance of cartons prepared according to this embodiment is approximately the same as that of the embodiment illustrated in FIG. 3.

Figure 6:
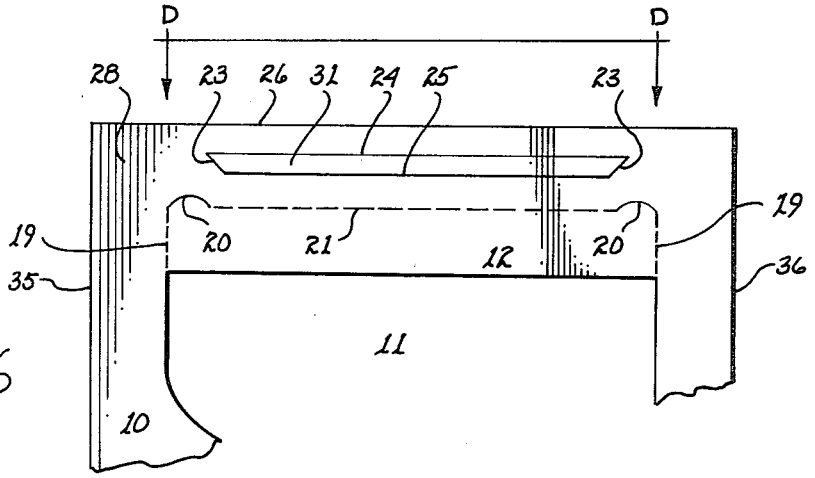
FIG. 6 illustrates an embodiment of the invention wherein two scoring lines are connected by additional angular scoring lines.

A fourth preferred embodiment of our invention is illustrated in FIG. 6, wherein scoring lines 24 and 25 are connected by angular scoring lines 23. Scoring lines 24 and 25 are shorter than the distance DD; however, scoring line 24 is slightly longer than scoring line 25. Angular scoring lines 23 angle outward from the ends of scoring line 25 at approximately a 45° angle until they intersect scoring line 24. It is not essential for the ends of angular scoring lines 23 to coincide with the ends of scoring line 24.

Figure 7:
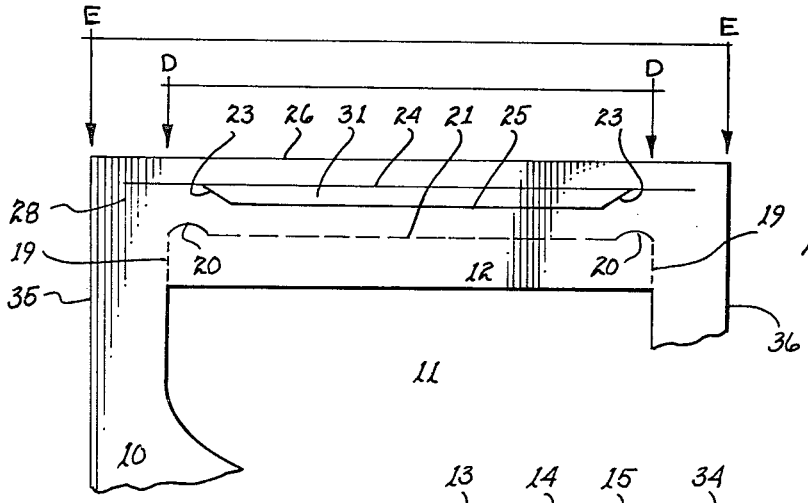
FIG. 7 illustrates another embodiment wherein two scoring lines are connected by angular scoring lines.

A fifth preferred embodiment of our invention is illustrated in FIG. 7, wherein scoring lines 24 and 25 are connected by angular scoring lines 23. Scoring line 25 is shorter than the distance DD, whereas scoring line 24 is slightly less than the distance EE, the distance across top panel 10 between panel edges 35 and 36. Angular scoring lines 23 angle outward from the ends of scoring line 25 at approximately a 45° angle until they intersect scoring line 24.

Figure 8:
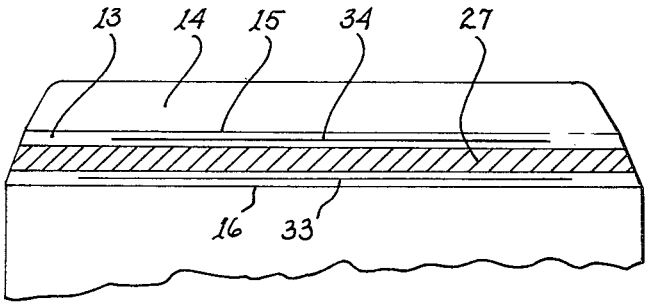
FIG. 8 illustrates an embodiment wherein two scoring lines are located across the bottom of the glue flap.

A sixth preferred embodiment of our invention is illustrated in FIG. 8, wherein two scoring lines 33 and 34 are located across the bottom of glue flap 13 on either side of adhesive 27. Scoring lines 33 and 34 define the approximate edges of a ply-separation area which separates when opening flap 14 is lifted in an upward manner. As opening flap 14 is lifted, stress is applied along scoring line 34 causing one or more plies of paperboard to separate from glue flap 13, rather than from edge section 28 as occurred for the previously illustrated preferred embodiments (FIGS. 3–7). When inspection flap 12 of a carton constructed according to this embodiment is lifted, lines of force AA and BB intersect scoring lines 33 and 34. However, tear resistance remains high because there is no ply-separation area in edge section 28 which is intersected by the lines of force. It will be noted that scoring lines 33 and 34 are variable in length and not necessarily of the same length.

It must be emphasized that our invention is not limited to the above-described preferred embodiments, but embodies all modified forms which are encompassed by the following claims.

We claim:

1. In a carton blank for constructing a carton for displaying a product such as bacon, wherein the blank is comprised of:

a. a top panel having a cut-out viewing area,
b. a bottom panel and side walls,
c. a glue flap,
d. an edge section of the top panel being located between the cut-out viewing area and the one edge of the top panel adjacent to the cut-out viewing area and having substantially the same width as the glue flap,
e. an inspection flap covering at least a portion of the cut-out viewing area and hingedly connected to the edge section of the top panel along a hinge line and having sides connected to the top panel by lines of weakness,
f. at least one scoring line adjacent a ply-separation area designed to provide easy opening of the carton, the invention comprising an arrangement wherein a single scoring line is located in the edge section adjacent to the inspection flap and defines the edge of a ply-separation area along which the glue flap attaches, said scoring line being no longer in length than the distance across the inspection flap between said lines of weakness and lying within an area bounded by the ends of said inspection flap, so that the lines of force initially created by lifting said inspection flap in an upward manner do not intersect said ply-separation area located in said edge section,

2. In a carton blank for constructing a carton for displaying a product such as bacon, wherein the blank is comprised of:

a. a top panel having a cut-out viewing area,
b. a bottom panel and said walls,
c. a glue flap,
d. an edge section of the top panel being located between the cut-out viewing area and the one edge of the top panel adjacent to the cut-out viewing area and having substantially the same width as the glue flap,
e. an inspection flap covering at least a portion of the cut-out viewing area and hingedly connected to the edge section of the top panel along a hinge line and having sides connected to the top panel by lines of weakness,
f. at least one scoring line adjacent a ply-separation area designed to provide easy opening of the carton, the invention comprising an arrangement wherein two scoring lines are located in the edge section at substantially the same location where the glue flap attaches, said scoring lines being no longer in length than the distance across the inspection flap between said lines of weakness and lying within an area bounded by the ends of said inspection flap, so that the lines of force initially created by lifting said inspection flap in an upward manner do not intersect a ply-separation area located in said edge section.

3. In a carton blank for constructing a carton for displaying a product such as bacon, wherein the blank is comprised of:

a. a top panel having a cut-out viewing area,
b. a bottom panel and side walls,
c. a glue flap,
d. an edge section of the top panel being located between the cut-out viewing area and the one edge of the top panel adjacent to the cut-out viewing area and having substantially the same width as the glue flap, e. an inspection flap covering at least a portion of the cut-out viewing area and hingedly connected to the edge section of the top panel along a hinge line and having sides connected to the top panel by lines of weakness, f. at least one scoring line adjacent a ply-separation area designed to provide easy opening of the carton, the invention comprising an arrangement wherein two scoring lines are located in the edge section at substantially the same location where the glue flap attaches, the scoring line adjacent to the inspection flap being no longer is length than the distance across the inspection flap between the lines of weakness and lying within an area bounded by the ends of said inspection flap, and the other scoring line being of variable length but with a maximum length less than the distance across the top panel, so that the lines of force initially created by lifting said inspection flap in an upward manner do not intersect a ply-separation area located in said edge section.

4. In a carton blank for constructing a carton for displaying a product such as bacon, wherein the blank is comprised of:

a. a top panel having a cut-out viewing area, b. a bottom panel and side walls, c. a glue flap, d. an edge section of the top panel being located between the cut-out viewing area and the one edge of the top panel adjacent to the cut-out viewing area and having substantially the same width as the glue flap, e. an inspection flap covering at least a portion of the cut-out viewing area and hingedly connected to the edge section of the top panel along a hinge line and having sides connected to the top panel by lines of weakness, f. at least one scoring line adjacent a ply-separation area designed to provide easy opening of the carton, the invention comprising an arrangement wherein two scoring lines are located in the edge section at substantially the same location where the glue flap attaches, the scoring line adjacent to the inspection flap being no longer in length than the distance across the inspection flap between said lines of weakness, and the other scoring line being of variable length but with a maximum length less than the distance across the top panel, said scoring lines being connected by angular scoring lines beginning at the end of the scoring line adjacent to the inspection flap and angling outward at approximately a 45° angle so that the lines of force initially created by lifting said inspection flap in an upward manner do not intersect said ply-separation area located in said edge section.

* * * * *